US007480480B2

(12) United States Patent
Endo et al.

(10) Patent No.: US 7,480,480 B2
(45) Date of Patent: Jan. 20, 2009

(54) IMAGE HEATING APPARATUS WITH HEAT PIPE FOR DECREASING UNEVENNESS IN TEMPERATURE DISTRIBUTION

(75) Inventors: Michiaki Endo, Abiko (JP); Masahiko Yokota, Abiko (JP); Kazuhisa Okuda, Tokyo (JP); Takatoshi Chiba, Kashiwa (JP); Shinsuke Ubayashi, Kashiwa (JP); Hiromasa Katayama, Toride (JP); Hiromitsu Uchida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 11/470,803

(22) Filed: Sep. 7, 2006

(65) Prior Publication Data

US 2007/0059062 A1 Mar. 15, 2007

(30) Foreign Application Priority Data

Sep. 13, 2005 (JP) ..... 2005-264784

(51) Int. Cl.
*G03G 15/20* (2006.01)

(52) U.S. Cl. ..... 399/329; 219/216; 399/330

(58) Field of Classification Search ..... 399/329, 399/328, 330, 334; 219/216, 619, 469; 347/156; 430/124.3

See application file for complete search history.

(56) References Cited

U.S. PATENT DOCUMENTS

| | | | | |
|---|---|---|---|---|
| 2002/0141795 | A1* | 10/2002 | Hirst et al. | 399/328 |
| 2005/0129434 | A1* | 6/2005 | Kim | 399/330 |
| 2005/0141934 | A1* | 6/2005 | Kim et al. | 399/330 |
| 2006/0013624 | A1* | 1/2006 | Kurotaka et al. | 399/329 |
| 2007/0059061 | A1 | 3/2007 | Katayama et al. | 399/329 |
| 2007/0059064 | A1 | 3/2007 | Okuda et al. | 399/329 |

FOREIGN PATENT DOCUMENTS

| | | | |
|---|---|---|---|
| JP | 04-360185 | A * | 12/1992 |
| JP | 06-004006 | A * | 1/1994 |
| JP | 08-262905 | A * | 10/1996 |
| JP | 09-016010 | A * | 1/1997 |
| JP | 09-090811 | A * | 4/1997 |
| JP | 9-319243 | | 12/1997 |
| JP | 3090983 | | 7/2000 |
| JP | 2001-147606 | A * | 5/2001 |
| JP | 2004-246240 | A * | 9/2004 |
| JP | 2005-049682 | A * | 2/2005 |

OTHER PUBLICATIONS

Machine translation of JP 06-004006 dated Feb. 18, 2008.*

* cited by examiner

*Primary Examiner*—Sophia S Chen
(74) *Attorney, Agent, or Firm*—Fitzpatrick, Cella, Harper & Scinto

(57) ABSTRACT

In a fixing apparatus capable of reducing unevenness in temperature distribution in an axial direction while reducing heat loss at an end portion, a fixing belt 11 extended around a fixation roller 13 and a fixation tension roller 14 is heated by a coil unit 28 for effecting induction heating. The fixation tension roller 14 is assembled by inserting a heat pipe 15 into a hollow roller 14*a*. At both end portions, the hollow roller 14*a* is covered with a cover portion having small holes.

5 Claims, 5 Drawing Sheets

LONGITUDINAL TEMPERATURE
DISTIBUTION OF TENSION ROLLER

IMAGE HEATING APPARATUS WITH HEAT PIPE FOR DECREASING UNEVENNESS IN TEMPERATURE DISTRIBUTION

FIELD OF THE INVENTION AND RELATED ART

The present invention relates to an image heating apparatus for heating an image on a recording material, particularly an image heating apparatus including heat movement means for uniformizing a temperature by utilizing a sealed-in liquid.

An image forming apparatus utilizing electrostatography includes a fixing apparatus located downstream from a transfer portion for transferring a toner image onto a transfer material. An ordinary fixing apparatus fixes a toner image on the surface of the transfer material by causing a heated fixation roller or a heated fixing belt to contact the transfer material and applying a pressure to the surface of the transfer material together with the toner image while heating the transfer material and the toner image. As a heating apparatus for the fixation roller, it is possible to use a resistance heating heater, a halogen lamp heater, an induction heating apparatus, a magnetic heating apparatus, etc.

Japanese Patent (JP-B) No. 3090983 has disclosed a cylindrical fixing belt provided with a halogen lamp heater at a center of rotation. Inside the cylindrical portion of the fixation roller to be heated by the halogen lamp heater at an inner surface, a plurality of heat pipes is disposed to uniformize a surface temperature distribution in an axial direction of the cylindrical portion.

Japanese Laid-Open Patent Application (JP-A) No. Hei 09-319243 has disclosed a fixing apparatus for heating a thick fixation roller by an induction heating apparatus. In this case, an induction heating apparatus is disposed outside the fixing apparatus formed of a magnetic material to permit heating of the fixation roller in a non-contact manner. Further, one cylinder-like heat pipe is disposed in an inner space of the thick fixation roller, and vapor heating exchange in the heat pipe is effected by rotation of the fixation roller to uniformize a distribution of surface temperature at the entire cylindrical surface of the heat pipe.

The above described fixing apparatuses, however, are accompanied with the following problems.

In the fixing apparatus described in JP-B 3090983, the end portion of the heat pipe is protruded from an end surface of the fixation roller, so that heat is efficiently conducted from the heat pipe to the protruded end portion which is more coolable, thus resulting in a waste of energy for heating.

Further, in the fixing apparatus described in JP-A Hei 09-319243, the heat pipe and the fixation roller have the same length and an end portion of the heat pipe contacts an end surface of the fixation roller from which a rotation axis (shaft) is protruded. As a result, heat is escaped from the heat pipe through the protruded rotation axis, so that energy for heating is wasted by that much.

SUMMARY OF THE INVENTION

An object of the present invention is to provide an image heating apparatus, including a heat pipe for reducing unevenness of a distribution of temperature of a heating member in its axial direction by utilizing latent heat of a liquid, capable of suppressing dissipation of heat from a longitudinal end surface of the heat pipe directly or via a member.

According to an aspect of the present invention, there is provided an image heating apparatus, comprising: a heating member for heating an image on a recording material; a heat pipe, disposed inwardly of the heating member, for decreasing unevenness in temperature distribution of the heating member in a longitudinal direction of the heating member; and a cover portion, disposed at an end portion of the heat pipe with a spacing in the longitudinal direction, for covering the end portion of the heat pipe.

DETAILED DESCRIPTION OF THE PREFERRED EMBODIMENTS

Hereinbelow, a fixing apparatus as an embodiment of an image heating apparatus according to the present invention and an image forming apparatus including the fixing apparatus will be described with reference to the drawings. Incidentally, the fixing apparatus in the present invention is not limited to one using a pair of fixing belts as in this embodiment but may also be a fixing apparatus using a pair of fixation rollers pressed against each other, a fixing apparatus using a fixing belt and a fixation roller, a fixing apparatus for effecting only heating without effecting pressure application, etc. In other words, the fixing apparatus in the present invention is applicable as such a fixing apparatus that a heat pipe is provided in at least one of high-temperature roller members kept at high temperatures at their surfaces.

Figure 1:
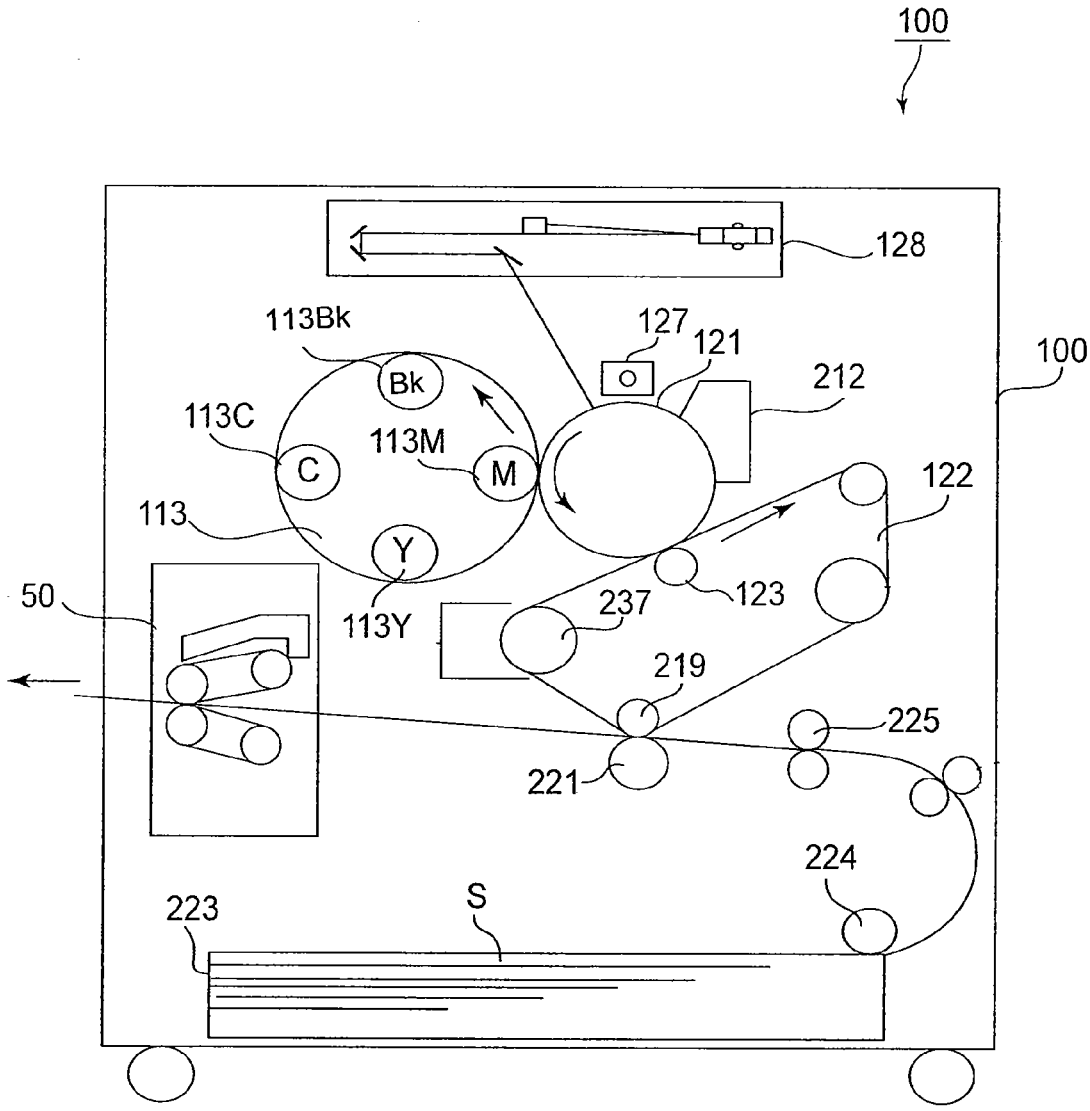
FIG. 1 is a schematic view for illustrating a constitution of a color electrophotographic printer as an embodiment of an image forming apparatus according to the present invention.
Figure 2:
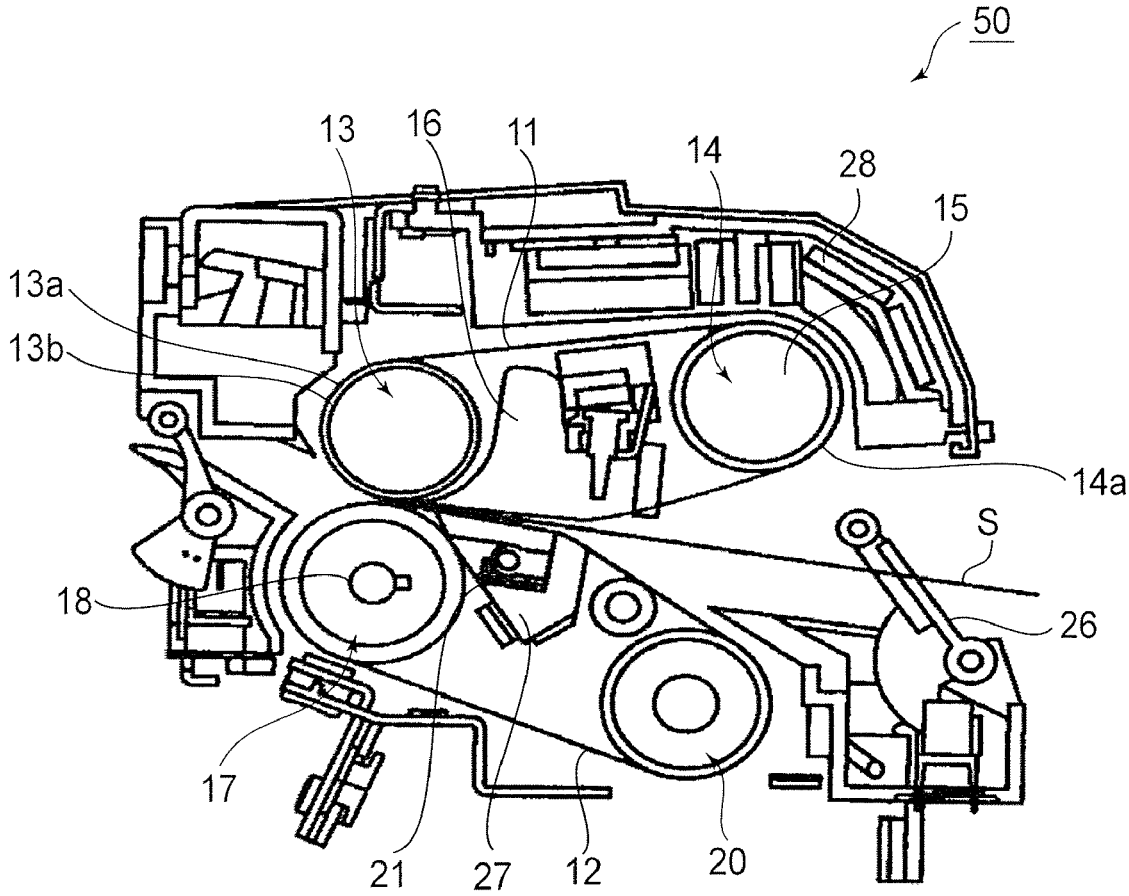
FIG. 2 is a schematic view for illustrating a constitution of a fixing apparatus as an embodiment of a fixing apparatus according to the present invention.

A fixing apparatus 50 (as shown in FIGS. 1 and 2) of this embodiment may also be incorporated into image forming apparatuses, other than a color electrophotographic printer 100 in this embodiment, such as a monochromatic copying machine, a facsimile apparatus, a monochromatic printer, and a multifunction machine which combines their functions.

Further, the fixing apparatus 50 and the color electrophotographic printer 100 in this embodiment are not limited to those employing combinations of constitutional members described below but may also be realized in other embodiments in which the constitutional members are partly or entirely replaced with their alternative members.

<Image Forming Apparatus>

FIG. 1 is an explanatory view for the color electrophotographic printer 100 as an embodiment of the image forming apparatus according to the present invention.

Referring to FIG. 1, in the color electrophotographic printer 100, a toner image which has been primary-transferred onto an intermediary transfer belt 122 is secondary-transferred onto a sheet S and then the sheet S is conveyed in the fixing apparatus 50, where the toner image is fixed on the sheet S as a recording material. Example of the sheet S on which the toner image is transferred and fixed may include plain paper, thick paper, a transparent sheet, envelop, etc. The sheet S is fed to the color electrophotographic printer 100 through a paper (sheet) feeding cassette 223 or an unshown paper feeding tray.

The color electrophotographic printer 100 includes a developing device 113 for colors of yellow (Y), magenta (M), cyan (C), and black (Bk). The developing device 113 includes a developing roller 113Y for Y (yellow), a developing roller 113M for M (magenta), a developing roller 113C for C (cyan), and a developing roller 113Bk for Bk (black). The respective developing rollers are moved to a position at which an associated developing roller contacts a photosensitive drum 121 as an image bearing member and develops an electrostatic latent image with toner of an associated color (Y, M, C or Bk) on the surface of the photosensitive drum 121.

Around the photosensitive drum 121, members including a primary charger 127, the developing device 113, a primary transfer device 123, and a cleaning apparatus 212 are disposed and subjected to formation and development of the electrostatic latent image by the rotation of the photosensitive drum in the following manner.

First, the surface of the photosensitive drum 121 cleaned by the cleaning apparatus 212 is electrically charged in a uniformly charged state by the primary charger 127. At the surface of the photosensitive drum 121 placed in the uniformly charged state, scanning with a laser beam modulated by an image signal is effected by a laser scanner 128. By the scanning exposure, on the surface of the photosensitive drum 121, electrostatic latent images for the respective colors are successively formed.

The respective electrostatic latent images are developed with associated color toners, respectively, by the developing device 113 to provide color toner images. A first toner image formed on the surface of the photosensitive drum 121 is primary-transferred onto the intermediary transfer belt 122 by the primary transfer device 123. Thereafter, a toner image of a subsequent color is formed on the surface of the photosensitive drum 121 and is superposed on the first toner image transferred on the intermediary transfer belt 122, in such a state that leading ends of the toner images are aligned with each other, in the same manner as in the case of the first toner image. The remaining two color toner images are also superposed on the previous color toner images on the intermediary transfer belt 122 in the same manner. As a result, on the intermediary transfer belt 122, a full-color toner image (including the four color toner images) is formed.

The thus formed full-color toner image formed on the intermediary transfer belt 122 is then a secondary-transferred onto the sheet S by a secondary transfer roller 221. Before the secondary transfer, the sheet S is fed from the paper feeding cassette 223 one by one by means of the paper feeding roller 224. The sheet S is placed in a stand-by state after subjected to correction of skew feeding by a pair of registration rollers 225. The pair of registration rollers 225 feeds the sheet S to a nip between the secondary transfer roller 221 and a separation roller 219 at timing in synchronism with the full-color toner image transferred onto the intermediary transfer belt 122. The sheet S onto which the full-color toner image is transferred by the secondary transfer roller 221 is conveyed into the fixing apparatus 50, where the toner image is fixed on the sheet S.

<Fixing Apparatus>

Figure 3:
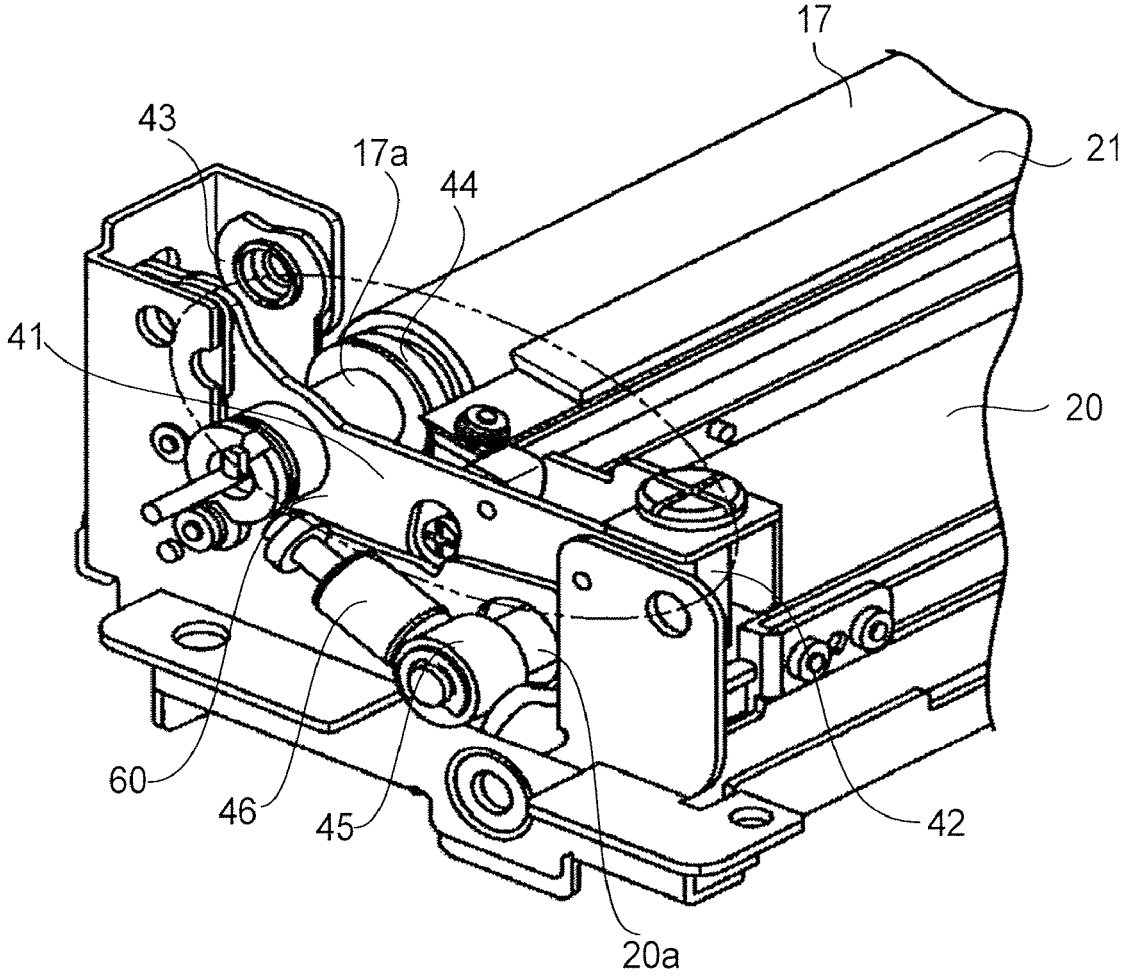
FIG. 3 is a perspective view for illustrating a pressing mechanism of a pressure belt.

FIG. 2 is an explanatory view of a constitution of a fixing apparatus as an embodiment of the fixing apparatus 50 in the present invention, and FIG. 3 is an explanatory view of a pressing mechanism of a pressure belt.

Referring to FIG. 2, the fixing apparatus 50 includes a fixing belt 11 contactable with a toner image transfer surface of the sheet S while being kept at a high temperature and the pressure belt 12, contactable with a back surface of the sheet S, for pressing the sheet S against the fixing belt 11. The fixing belt 11 and the pressure belt 12 are assembled so that they can be pressed against and moved away from each other. More specifically, the belts 11 and 12 are circularly moved together in a contact state under pressure during passing of the sheet S and are circularly moved individually in a separation state during standby of the sheet S.

In this embodiment, heating means includes a coil unit 28 as magnetic flux generation means, the fixing belt 11 as a heat generation member which generates heat by magnetic flux from the coil unit 28, and a fixing roller 13 and a fixation tension roller 14 as stretching members for stretching the fixing belt 11 therearound at a predetermined tension.

The coil unit 28 includes an exciting coil for penetrating magnetic flux by energization, a magnetic core for collecting generated magnetic flux, a holder for supporting the exciting coil and the magnetic core, etc.

The fixing belt 11 is an endless belt extended under tension around the fixing roller 13 for rotationally driving the fixing belt 11 and the fixation tension roller 14 which is as the stretching member for stretching the fixing belt 11 and as a heat source.

The fixing belt 11 has a 75 μm-thick base layer of nickel and a 300 μm-thick elastic layer disposed at an outer peripheral surface of the base layer. The elastic layer is formed of silicone rubber and has a JIS-A hardness of 20 degrees and a thermal conductivity of 0.8 W/mK. At an outlet of the nip between the fixing belt 11 and the pressure belt 12, the sheet S is effectively separated from the belts by deforming the elastic layer, thus being prevented from winding around the fixing belt 11.

As a material for the elastic layer, it is also possible to use other known elastic materials such as fluorine-containing rubber and the like. At an outer peripheral surface of the elastic layer, a 30 μm-thick layer of fluorine-containing resin (e.g., PFA or PTFE) is provided as a surface release layer.

The pressure belt 14 has a 75 μm-thick base layer of nickel, a 300 μm-thick elastic layer disposed at an outer peripheral surface of the base layer, and a 30 μm-thick layer of fluorine-containing resin (PFA) as a surface release layer.

The fixation tension roller 14 is prepared by inserting one heat pipe 15 as a heat transfer means into an iron-made hollow roller 14*a* having an outer diameter of 20 mm, an inner diameter of 18 mm, and a thickness of 1 mm. A pipe material for the heat pipe 15 is copper and in the heating pipe 15 a small amount of pure water is contained as a heating medium.

The fixation tension roller 14 is assembled by outwardly biasing both ends of a rotation axis thereof with unshown strings, thus also functioning as a tension roller for applying a tension to the fixing belt 11.

The fixation roller 13 is rotationally driven by an unshown drive mechanism (motor and drive gear train). The fixation roller 13 is an elastic roller prepared by providing a silicone rubber layer 13*a* as an elastic layer on a surface of a core metal of iron alloy having an outer diameter of 20 mm and an inner diameter of 18 mm. The silicone rubber layer 13*a* has a JIS-A hardness of 15 degrees and a thermal conductivity of 0.8 W/mK. By the silicone rubber layer 13*a*, an amount of heat conduction (transfer) to the core metal 13*b* is decreased and a warm-up time is also reduced.

By providing the silicone rubber layer 13*a* to the fixation roller 13, a friction transmission force is created between the fixation roller 13 and the fixing belt 11, so that the rotation of the fixing belt 11 can be effectively performed by the rotation of the fixation roller 13.

Further, the pressure roller 17 is pressed against the fixation roller 13 to deform the soft silicone rubber layer 13*a*, so that a nip outlet which ensures a separative performance of the sheet from the fixing belt 11 is formed. The pressure roller 17 is an iron alloy having an outer diameter of 23 mm and an inner diameter 20 mm and on a central axis thereof, a halogen heater 18 is disposed. The pressure roller 17 rotates outside the halogen heater 18.

A fixation pad 16 disposed upstream from the fixation roller 13 along the fixing belt 11 pushes the fixing belt 11 from the inside of the fixing belt 11 to cause the fixing belt 11 to contact the pressure belt 12 under pressure. The fixation pad 16 is prepared by coating a core metal, of a rigid drawn material of SUS, with a sliding sheet, so that a sliding resistance is decreased when they rub against each other. The sliding sheet is a sheet material prepared by coating non-woven cloth of glass fiber with a fluorine-containing resin material.

The pressure belt 12 is stretched by the pressure roller 17 and a pressure tension roller 20 which is formed of iron alloy and has an outer diameter of 20 mm and an inner diameter of 16 mm.

Inside the pressure belt 12, an elastic pressure pad 21 and a rigid pressure cross-member 27 are disposed upstream from the pressure roller 17 and provide the pressure belt 12 with a predetermined circular path while pressing the pressure belt 12 against the fixing belt 11. The pressure pad 21 can be constituted by silicone rubber or fluorine-containing rubber. In this embodiment, a silicone rubber material having a JIS-A hardness of 15 degrees is used. The pressure cross-member 27 not only supports the pressure pad 21 but also functions as a guide for determining a bending position of the pressure belt 12.

The pressure pad 21 is supported by the pressure cross-member 27 to abut against the pressure belt 12 and outwardly biases the pressure belt 12 at a position protruded from the pressure cross-member 27. In this embodiment, an amount of protrusion is 1 mm.

The surfaces of the pressure pad 21 and the pressure cross-member 27 are coated with a sliding sheet similarly as in the case of the fixation pad 16, so that a sliding resistance is decreased when they and an inner surface of the pressure belt 12 rub against each other.

FIG. 3 shows a pressure mechanism 60, for pressing the pressure belt 12 against the fixing belt 11, from which the pressure belt 12 is removed. Referring to FIG. 3, a pressing plate 41 is rotationally moved around a hinge 43. A pressure spring 42 presses the pressing plate 41 toward above in the figure, i.e., in a direction toward the fixation roller 13 (FIG. 2). By a bearing 44 attached to the pressing plate 41, a journal 17*a* of the pressure roller 17 is rotatably supported. Further, by a bearing 45 movably attached along the pressing plate 41, a journal 20*a* of the tension roller 20 is rotatably supported. The bearing 45 is biased toward the right-hand direction in the figure, i.e., outwardly, by a spring 46, thus applying a tension to the pressure belt 12 (FIG. 2).

Referring again to FIG. 2, the nip created between the fixation pad 16 and the pressure pad 21 extends in a length of approximately 18 mm in the conveyance direction of the sheet S. By supplying predetermined friction energy to the sheet S in a short time, the nip contributes to high-speed image formation.

The pressure spring 42 shown in FIG. 3 applies a predetermined pressure to the pressing plate 41 holding the pressure pad 21 so as to create a fixation nip between the fixation pad 16 and the pressure pad 21 shown in FIG. 2. The predetermined pressure is a pressing force of 750N supplied from the pressure mechanism 60. A pressing force of 350N of the pressing force of 750N is applied to the journal 17*a* of the pressure roller 17, so that a separation nip having a small curvature is created with deformation of the above described silicone rubber layer 13*a* to permit a separation action of the sheet S against the fixing belt 11.

The fixation roller 13 and the pressure roller 17 are supplied with a driving force by an unshown motor, thus being rotated at a predetermined peripheral speed of approximately 210 mm/s during the fixing operation. More specifically, there is a difference in peripheral speed between the fixation roller 13 and the pressure roller 17. The peripheral speed of the fixation roller 13 is 210 mm/s and the peripheral speed of the pressure roller 17 is 103% of that of the fixation roller 13.

In order to provide such a difference in peripheral speed between the fixation roller 13 and the pressure roller 17, a gear train for permitting 103% driving force transmission is disposed between the fixation roller 13 and the pressure roller 17. The gear train is disposed via the hinge 43 (FIG. 3), so that it is possible to ensure good drive force transmission even when the pressing plate 41 is rotationally moved. Other than the use of the gear train, it is also possible to transmit the driving force by various methods such as one using a timing belt and one in which the respective rollers are individually driven by motors.

In this embodiment, the thin endless belts are employed on both of the fixation side and the pressure side as members, associated with fixation, contacting the sheet S. As a result, it is possible to achieve a low heat capacity at a portion required to be kept at a higher temperature than that of a conventional member. Therefore, reduction in warm-up time (required for placing the color electrophotographic printer 100 from a power-on state to a fixable state) is realized.

When the fixation roller 13 is rotationally moved by an unshown driving mechanism during the image formation, the fixing belt 11 is also supplied with a rotation force by a frictional force between the fixing belt 11 and the fixation roller 13. As shown in FIG. 1, the sheet S is conveyed from the secondary transfer roller 221. A conveying force of the fixing apparatus (fixing device) 50 is very small compared with that of the secondary transfer roller 221. For this reason, when the sheet S is pulled toward the fixing apparatus 50 side between the secondary transfer roller 221 and the fixing apparatus 50, a difference in speed between the sheet S and the secondary transfer roller 221 is caused to occur to result in slippage of image. Therefore, the peripheral speed of the fixing belt 11 is made slightly slower than the peripheral speed of the secondary transfer roller 221, so that the sheet S is slightly looped between the secondary transfer roller 221 and the fixing apparatus 50. More specifically, when an inlet sensor 26 (FIG. 2) of the fixing apparatus 50 detects a predetermined amount of loop of the sheet S, the formation of loop is controlled by finely adjusting a speed of the motor for the driving mechanism.

In the thus constituted fixing apparatus 50, the sheet S carrying thereon an unfixed toner image is conveyed into the fixation nip between the fixing belt 11 and the pressure belt 12 in such a state that the fixing belt 11 is temperature-controlled to have a predetermined fixing temperature. The sheet S is guided into the fixation nip with the unfixed toner image carrying surface toward the fixing belt 11 and in the nip, the unfixed toner image on the sheet S is nipped and conveyed while being in close contact with the outer peripheral surface of the fixing belt 11. As a result, heat is applied to the sheet S principally from the fixing belt 11 together with pressure application to fix the unfixed toner image on the surface of the sheet S.

Further, the fixation roller 13 in the fixing belt 11 is the elastic roller having the silicone rubber layer 13*a* and the pressure roller 17 in the pressure belt 12 is the rigid iron alloy roller. For this reason, at the outlet of the nip between the fixing belt 11 and the pressure belt 12, the fixation roller 13 is largely deformed. As a result, the fixing belt 11 is also largely waved and deformed, so that the toner image carrying sheet S is separated by curvature from the fixing belt by its own rigidity.

<Fixation Tension Roller>

Figure 4:
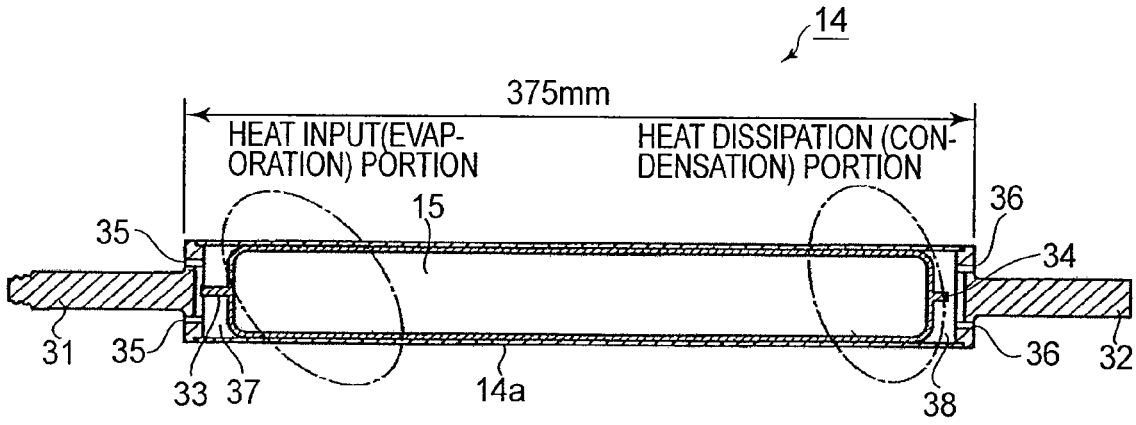
FIG. 4 is a sectional view of a fixation tension roller in an axial direction.
Figure 5:
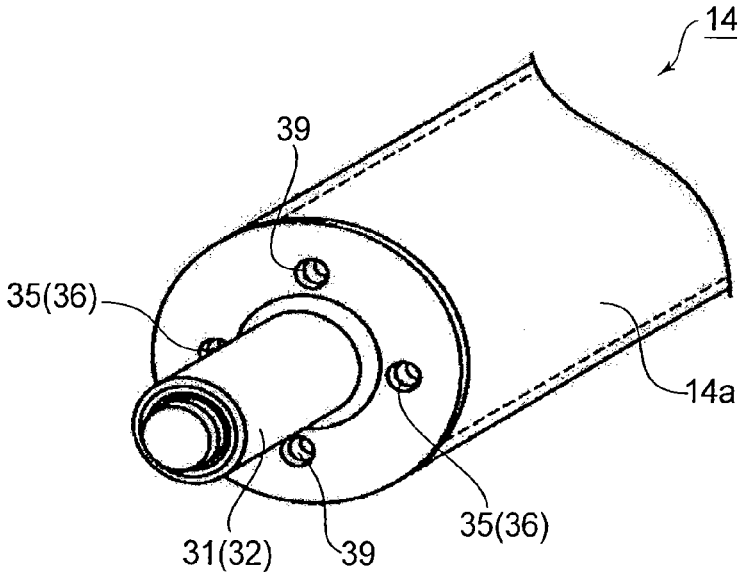
FIG. 5 is a perspective view of the fixation tension roller in the neighborhood of an end surface thereof.
Figure 6:
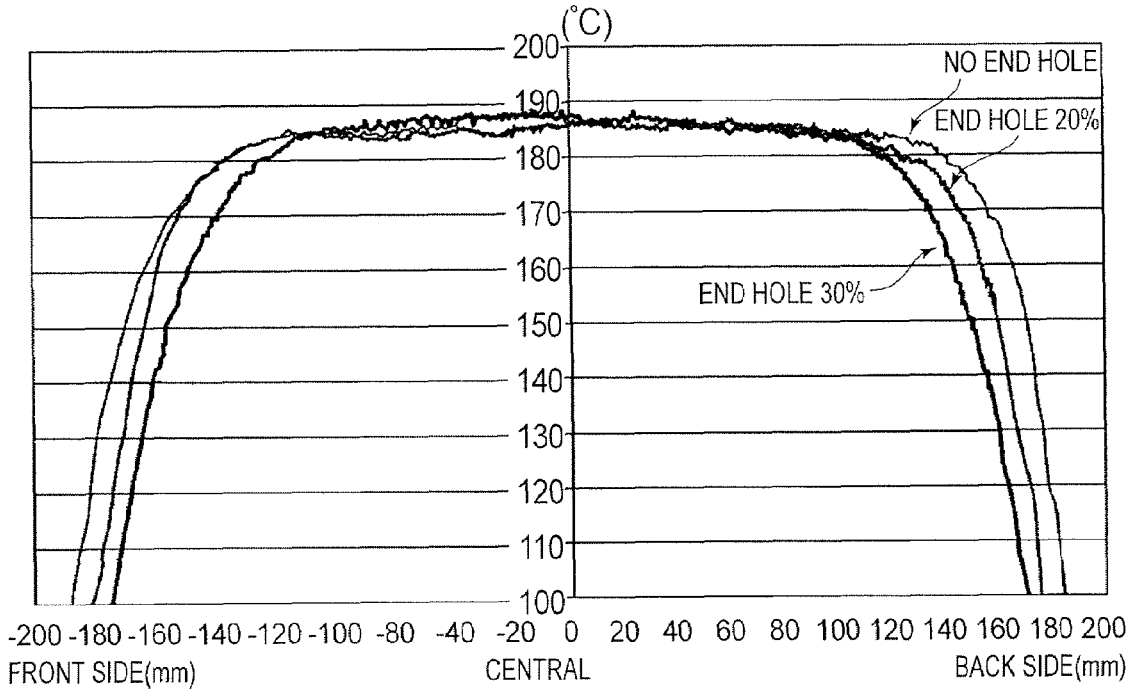
FIG. 6 is a graph showing a distribution of surface temperature of the fixation tension roller in its axial direction.

FIG. 4 is a sectional view of the fixation tension roller in its axial direction, FIG. 5 is a perspective view at an end surface of the fixation tension roller, and FIG. 6 is a graph showing a surface temperature distribution of the fixation tension roller in its axial direction.

The fixation tension roller 14 is heated by induction heat so as to keep a predetermined high temperature and heats the fixing belt 11 and the fixation pad 16. Further, the fixation tension roller 14 is brought into surface contact with the induction-heated fixing belt 11 to uniformize a distribution of surface temperature of the fixing belt 11.

As shown in FIG. 4, the fixation tension roller 14 has a length of 375 mm, and into the fixation tension roller 14, one heat pipe 15 is inserted substantially in a full length of the fixation tension roller 14. As described above, the fixation tension roller 14 includes the iron hollow roller 14*a* having the outer diameter 20 mm, the inner diameter 18 mm, and the thickness of 1 mm. Into the hollow roller 14*a*, the heat pipe 15 of copper pipe material is inserted. A coefficient of thermal expansion of the hollow roller 15 at a portion contacting the fixation tension roller 14 is larger than that of the outer hollow roller 14*a*, so that the heat pipe 15 inserted at a normal temperature is in close contact with the hollow roller 14*a* at a temperature (200° C.) during fixation.

The hollow roller 15 is cover with the iron pipe-like hollow roller 14*a* substantially in the entire area, and at both end portions of the hollow roller 14*a*, the flanges 31 and 32 each fixing the journal (support axis) are press-fitted. In this embodiment, the hollow roller 14*a* functions as a stretching member for stretching the fixing belt 11 (also a support member for supporting the heat pipe) and a heat generation member for generating heat by magnetic flux from the magnetic flux generation means.

Inside the hollow roller 14*a*, the heat pipe 15 is positioned at a longitudinal central portion and brought into close contact with the hollow roller 14*a* by effecting cladding so as not to shift in the longitudinal direction. By the close contact of the heat pipe 15 with the hollow roller 14*a*, a heat transfer effect is also enhanced.

Here, the flanges 31 and 32 as the cover portions for covering the end portions of the fixation tension roller 14 separate the end portions of the heat pipe 15 from the outside of the fixation tension roller 14, so that heat dissipation from the end portions are decreased. In other words, the flanges 31 and 32 constitute partition walls for separating the heat pipe 15 and the outside of the fixation tension roller 14.

The hollow roller 14*a* and the flanges 31 and 32 are connected with no gap therebetween and even if water is stored in the hollow roller 14*a*, the water is prevented from leaking from the connection portions. Between the end portions of the heat pipe 15 and the flanges 31 and 32, spacings 37 and 38 are provided. The spacings 37 and 38 function as a heat insulation space, so that a cooling (condensation) portion is not created at the end portions. As a result, heat loss through the flanges 31 and 32 is reduced. The flanges 31 and 32 are provided with rent holes (openings) 35 and 36 at positions close to the centers of the flanges 31 and 32.

Incidentally, in the spacings 37 and 38, a heat insulating material such as glass wool or the like may be disposed to improve not only heat insulating performance but also silencing performance.

Here, a principle of heat transfer by the heat pipe 15 will be described. Generally, the heat pipe has such a structure that a small amount of water (operating fluid: water in this embodiment) is sealed in a well-closed container which has been evacuated and at an inner wall of the container, a capillary structure (wick) is formed. When a part of the thus constituted heat pipe is heated, the operating fluid is vaporized at the heated portion to adsorb latent heat of vaporization. On the other hand, increased vapor pressure causes condensation (liquefaction) at a low temperature portion to dissipate latent heat of condensation. The liquefied operating fluid at the low temperature portion is diffused by the capillary structure to be returned to the heated portion. As a result, until a difference in temperature between the low temperature portion and the heated portion is eliminated, such a cycle that vapor is moved to the low temperature portion and the operating liquid is returned from the low temperature portion to the heated portion is continuously caused to occur. As a result, a large amount of heat is quickly moved to eliminate the temperature difference.

Further, in this embodiment, as shown in FIG. 2, the fixation tension roller 14 also functions as such a heat generation member which is induction-heated by the coil unit 28 disposed outside the fixing belt 11 in non-contact with the fixing belt 11. The fixing belt 11 itself has the 75 μm-thick nickel layer to be heated by induction heating as described above, so that the fixation tension roller 14 is induction-heated together with the fixing belt 11 at a portion along the coil unit 28. Further, on the downstream side of the coil unit 28, the fixation tension roller 14 adjusted to have a uniform surface temperature by the heat pipe 15 are brought into surface contact with the fixing belt 11 to uniformize the temperature distribution of the fixing belt 11.

When magnetic flux is generated by passing a high-frequency current through the coil unit 28, the magnetic flux from the coil unit 28 penetrate through the fixing belt 11 and the fixation tension roller 14. The penetration magnetic flux causes eddy current in the hollow roller 14*a* of the fixation tension roller 14 and the eddy current penetrates heat to increase the temperatures of the fixing belt 11 and the fixation tension roller 14. The temperature difference between the heated portion and the low temperature portion (which is not heated) in the fixation tension roller 14 caused by the coil unit 28 is quickly eliminated by the rotation of the hollow roller 14*a* and the heat diffusion through the heat pipe 15. In this manner, the surface temperature distribution of the fixation tension roller 14 is kept at a substantially uniform level and such an effect that the startup time of the fixing apparatus 50 is also achieved.

In this embodiment, on the basis of an output of an unshown temperature detection sensor (thermistor) which is disposed downstream from the fixation tension roller 14 in contact with a central portion of the fixing belt 11, temperature control for increasing and decreasing an amount of heating by the coil unit 28 is effected. The heating amount by the coil unit 28 is adjusted by an applied voltage modulated by a frequency of 20 kHz to 1 MHz. As a result, the fixation tension roller 14 and the fixing belt 11 are temperature-controlled in a predetermined temperature range with 180° C. as a center value in the standby state of the sheet S.

Incidentally, when the heat pipe 15 is heated, an inner pressure thereof is increased, so that a force for expanding the heat pipe 15 itself is exerted on the heat pipe 15. At the end portions of the heat pipe 15, weak portions 33 and 34 are intentionally provided. In this embodiment, such a safety measure that the fixing apparatus is not broken when the heat pipe is broken is taken in preparation for emergency. More specifically, as shown in FIG. 4, the air vents (openings) 35 and 36 are provided in the flanges 31 and 32 at the portions close to the centers of the flanges 31 and 32. As a result, even if the heat pipe 15 is broken, the pressure of the heat pipe 15 can be caused to leak out to the outside of the fixation tension roller 14 through the air vents 35 and 36. Therefore, it is possible to prevent the breakage of the fixing apparatus. Further, by providing the air vents 35 and 36 at positions close to the centers of the flanges 31 and 32, it is possible to prevent the water in the heat pipe 15 from leaking into the fixing apparatus. Incidentally, the flanges 31 and 32 are actually provided with thin resin-made insulating collars (not shown) which are attached to the flanges 31 and 32 through screw holes 39 and are caused to run against the edges of the fixing belt 11, so that the pressure leaks out through gaps between the insulating collars and the flanges 31 and 32.

Further, as shown in FIG. 4, the water leaked from the heat pipe 15 is accumulated in the spacings 37 and 38 in the fixation tension roller 14, so that the water cannot leak the fixing apparatus 50. Further, a described above, the air vents 35 and 36 are disposed in the neighborhood of the rotation centers of the flanges 31 and 32. For this reason, even when the fixation tension roller 14 is rotated for a time after the water leakage from the heat pipe 15 occurs, the water cannot leak into the fixing apparatus 50. Therefore, such a possibility that the water damages the fixing apparatus 50 and the color electrophotographic printer 100 is very low.

According to experimental results shown in FIG. 6 by the inventors, it is desirable that the sum of opening areas of the air vents 35 and 36 is up to 20% of a cross-sectional area of the heat pipe 15. When a temperature distribution of the fixation tension roller 14 in its longitudinal direction is measured by changing a diameter of the air vents 35 and 36 located at the end portions of the fixation tension roller 14, the temperature distribution in the case where the sum of opening areas of the air vents 35 and 36 is up to 20% of the cross-sectional area of the heat pipe 15 is not much changed. In this embodiment, each of the air vents 35 and 36 has a diameter of 1 mm. Further, as shown in FIG. 6, the change in temperature distribution becomes large after the sum of opening areas substantially exceeds approximately 30% (5 mm in air vent diameter).

When the temperature at the both end portion s of the fixation tension roller 14 is lowered, during the fixation of the sheet S, a lowering in temperature at the edge portions of the fixing belt 11 is caused to occur, thus resulting in image failures such as fixation failure, fixation irregularity, and irregularity in gloss.

Further, as a result of comparison between the presence and the absence of the heat pipe 15 with respect to the warm-up time of the fixing apparatus 50 during the startup of the color electrophotographic printer 100, it has been confirmed that the case of using the heat pipe 15 improves 15% in terms of a time required for increasing the temperature of the fixing apparatus 50 to a proper temperature, compared with the case where the heat pipe 15 is not used. The principle of uniform temperature distribution of the fixing belt 11 is as described above.

Other Embodiments (1) The image heating apparatus according to the present invention is not limited to the above-described fixing apparatus but may also be effectively applicable to other image heating apparatus such as a temporary fixing apparatus for temporarily fixing an unfixed image on a material to be heated, and a surface modifying apparatus for modifying an image surface property such as gloss or the like by reheating a material, to be heated, on which a fixed image is carried.

(2) In the above described embodiments, the fixing apparatus in which the toner image on the material to be heated (recording material) is fixed by the induction heating belt is described but may also be those employing a halogen lamp, a ceramic heater, and the like as a heat source.

In the above described embodiments, the belt is used for heating the material to be heated but the present invention is not limited thereto. For example, the material to be heated may also be heated by heat of a hollow heating roller which is directly heated by induction heat or indirectly heated by a halogen lamp or the like without using the belt. This constitution achieves a similar effect. In this case, the heat pipe is disposed in the heating roller and the heating roller is covered with covering portions at end portions thereof.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 264784/2005 filed Sep. 13, 2005, which is hereby incorporated by reference.

What is claimed is:

1. An image heating apparatus, comprising:

a coil;

a rotatable heating member for generating heat by magnetic flux generated by energization of said coil;

a belt member, supported by said rotatable heating member, for heating an image on a recording material by heat;

a heat pipe, which contains a liquid and is disposed in said rotatable heating member, for decreasing unevenness in temperature distribution of said rotatable heating member in a longitudinal direction of said rotatable heating member;

a first cover portion, disposed with a spacing with respect to one of two end portions of said heat pipe in the longitudinal direction of said rotatable heating member, for covering the one of two end portions of said rotatable heating member in the longitudinal direction of said rotatable heating member, said first cover portion provided with a first opening penetrating through said fist cover portion;

a first shaft, provided to said first cover portion, for permitting support of said rotatable heating member by said image heating apparatus;

a second cover portion, disposed with a spacing with respect to the other end portion of said heat pipe in the longitudinal direction of said rotatable heating member, for covering the other end portion of said rotatable heating member in the longitudinal direction of said rotatable heating member, said second cover portion provided with a second opening penetrating through said second cover portion; and a second shaft, provided to said second cover portion, for permitting support of said rotatable heating member by said image heating apparatus.

2. An apparatus according to claim 1, wherein said first opening has a total area of not more than 20% of a cross-sectional area of said heat pipe, and said second opening has a total area of not more than 20% of a cross-sectional area of said heat pipe.

3. An apparatus according to claim 1, wherein the first and second openings are provided close to a center of rotation of said heat pipe.

4. An apparatus according to claim 1, wherein said belt member has a layer for generating heat by magnetic flux generated by energization of said coil.

5. An apparatus according to claim 1, said image heating apparatus further comprising a support member for supporting said heat pipe in contact with an outer surface of said heat pipe.

* * * * *